US010408427B2

(12) United States Patent
Matthews

(10) Patent No.: US 10,408,427 B2
(45) Date of Patent: Sep. 10, 2019

(54) PORTABLE FASHION MODELING RUNWAY

(71) Applicant: Tahwanda Matthews, Chicago, IL (US)

(72) Inventor: Tahwanda Matthews, Chicago, IL (US)

( * ) Notice: Subject to any disclaimer, the term of this patent is extended or adjusted under 35 U.S.C. 154(b) by 78 days.

(21) Appl. No.: 15/449,221

(22) Filed: Mar. 3, 2017

(65) Prior Publication Data

US 2018/0252391 A1 Sep. 6, 2018

(51) Int. Cl.

| | |
|---|---|
| ***A63J 1/00*** | (2006.01) |
| ***F21V 9/30*** | (2018.01) |
| ***F21V 33/00*** | (2006.01) |

(52) U.S. Cl.

CPC ..... *F21V 9/30* (2018.02); *A63J 1/00* (2013.01); *F21V 33/006* (2013.01)

(58) Field of Classification Search

CPC ..... F21V 9/30; F21V 23/0485
USPC ..... 362/153
See application file for complete search history.

(56) References Cited

U.S. PATENT DOCUMENTS 4,744,012 A * 5/1988 Bergkvist ..... G09F 13/20 362/84
5,579,134 A * 11/1996 Lengyel ..... F21V 5/02 349/62
7,670,026 B1 * 3/2010 Hawkins ..... A47G 27/0212 362/153
7,990,352 B2 * 8/2011 Hu ..... G02F 1/133603 345/102
8,850,770 B2 * 10/2014 Roen ..... E04B 5/48 52/263
9,851,612 B2 * 12/2017 Davis ..... G02F 1/13718
2003/0215596 A1 * 11/2003 Nolt ..... A62B 3/00 428/44
2004/0240230 A1 * 12/2004 Kitajima ..... F21S 8/032 362/558
2011/0016815 A1 * 1/2011 Yang ..... E04F 15/02 52/396.04
2013/0340535 A1 * 12/2013 Sano ..... G01F 1/00 73/861.42
2014/0237102 A1 * 8/2014 Newman ..... H04M 1/72569 709/224
2014/0245692 A1 * 9/2014 Bowers ..... E04F 15/02038 52/582.2
2014/0375434 A1 * 12/2014 Puljan ..... F21V 33/004 340/12.5
2015/0113908 A1 * 4/2015 Ramachandra ... E04F 15/02038 52/745.13
2015/0374264 A1 * 12/2015 Haas ..... G01V 9/00 73/862.541

(Continued)

OTHER PUBLICATIONS

Boogie Nights, Released Oct. 31, 1997, www.youtube.com/watch?v=s9siMXbuc5o (See 1:37-2:07) (Year: 1997).*

*Primary Examiner* — Jong-Suk (James) Lee
*Assistant Examiner* — Christopher E Dunay
(74) *Attorney, Agent, or Firm* — Foley Lardner LLP

(57) ABSTRACT

A portable fashion modeling runway comprising one or more runway panels disposed on an underlying surface and positioned proximate to one or more other runway panels, wherein each of the runway panels comprise one or more luminescent materials.

12 Claims, 4 Drawing Sheets

(56) References Cited

U.S. PATENT DOCUMENTS

2016/0037610 A1* 2/2016 Kiser ..... H05B 37/0227
315/360
2017/0370110 A1* 12/2017 Feys ..... E04F 15/105

* cited by examiner

PORTABLE FASHION MODELING RUNWAY

FIELD OF THE INVENTION

The present invention relates generally to the field of fashion modeling. More particularly, the present invention relates to systems and methods for a portable fashion modeling runway.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Fashion runways are a common tool used by fashion designers to exhibit apparel on models. Fashion runways are traditionally an elevated, relatively narrow platform that models walk up and down exhibiting apparel to spectators. Traditional runways are large, require a large amount of space to store, transport, and use, and often require many people to maneuver and assemble. Traditional runways are also very expensive. As such, traditional runways are neither affordable nor well-suited for modestly-equipped retailers or designers to own and operate for fashion shows. One way to overcome the size and expense of traditional runways is to simply not have a runway; however, it is difficult for models to know where they are to walk to exhibit the apparel. Another option is to simply have a length of red carpet. However, that approach requires lighting and is, therefore, incongruous with the growing trend of black light and "glow-in-the-dark" parties and events.

SUMMARY OF THE INVENTION

One embodiment provides for a portable fashion modeling runway. The portable fashion modeling runway comprises one or more runway panels disposed on an underlying surface and positioned proximate to one or more other runway panels, wherein each of the runway panels comprise one or more luminescent materials.

Another embodiment provides for a method of marking a pathway. The method of marking a pathway comprises placing a first panel on an underlying surface; placing a second panel adjacent the first panel, the second panel on the underlying surface and overlapping with the first panel and removably affixed to the first panel; providing electrical power to the first panel and the second panel; illuminating a plurality of lights associated with the first panel and the second panel; wherein the first panel and the second panel each comprise one or more luminescent materials.

These and other features of the invention, together with the organization and manner of operation thereof, will become apparent from the following detailed description when taken in conjunction with the accompanying drawings, wherein like elements have like numerals throughout the several drawings described below.

DETAILED DESCRIPTION

Figure 1:
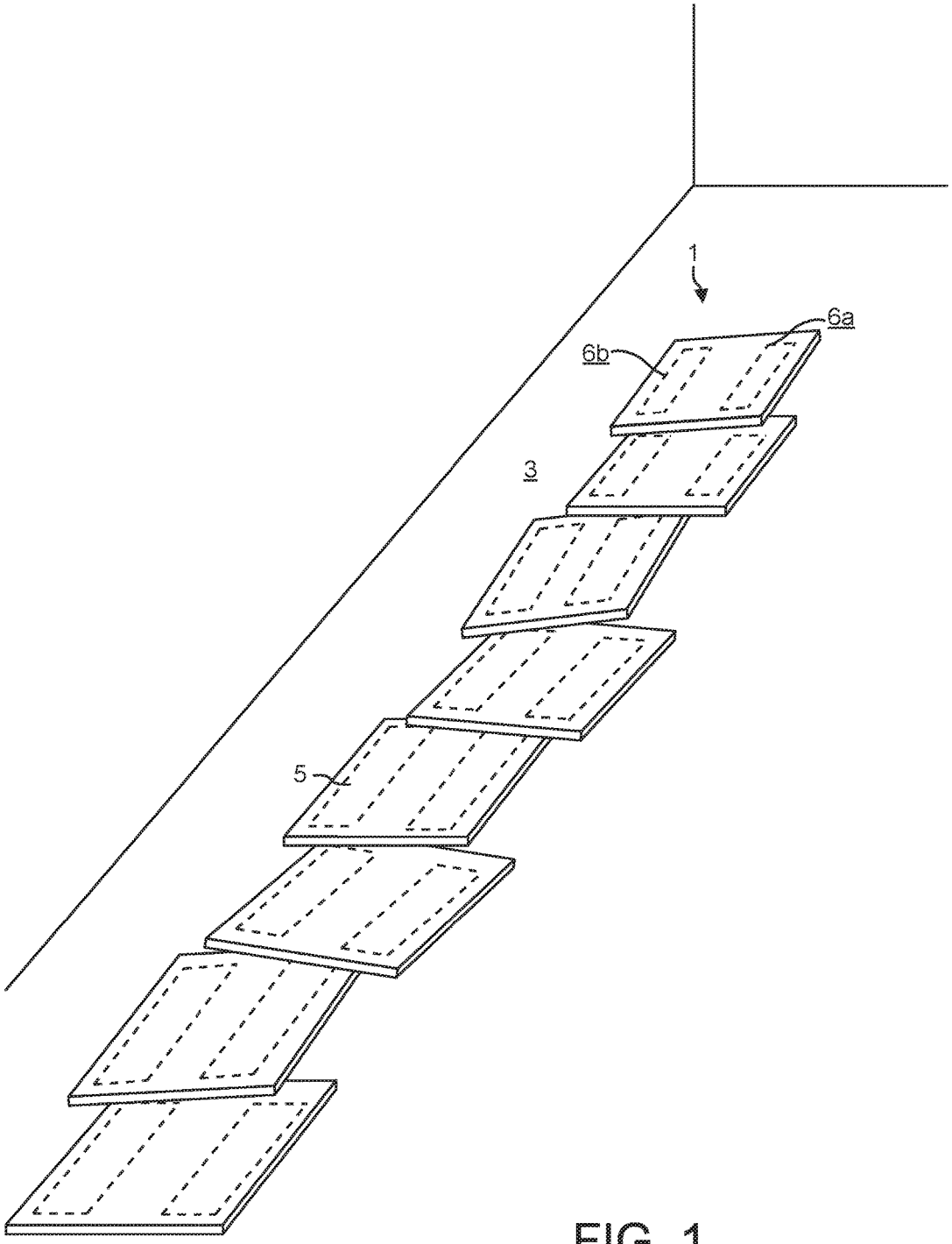
FIG. 1 is a front perspective view of a portable fashion modeling runway system constructed in accordance with an embodiment of the present invention and shown in the assembled position.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Figure 3:
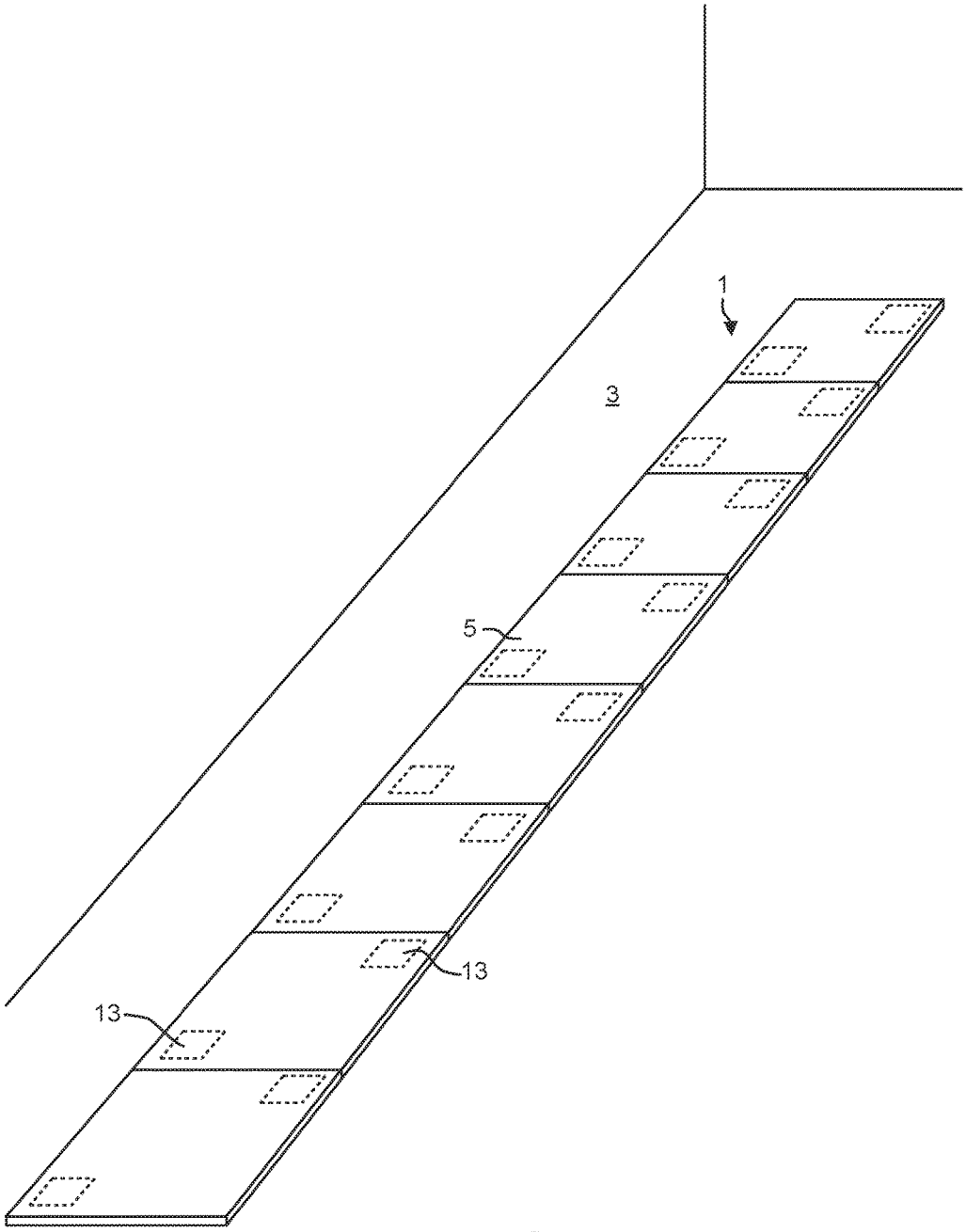
FIG. 3 is a front perspective view of a portable fashion modeling runway system constructed in accordance with yet another embodiment of the present invention and shown in the assembled position.
Figure 4:
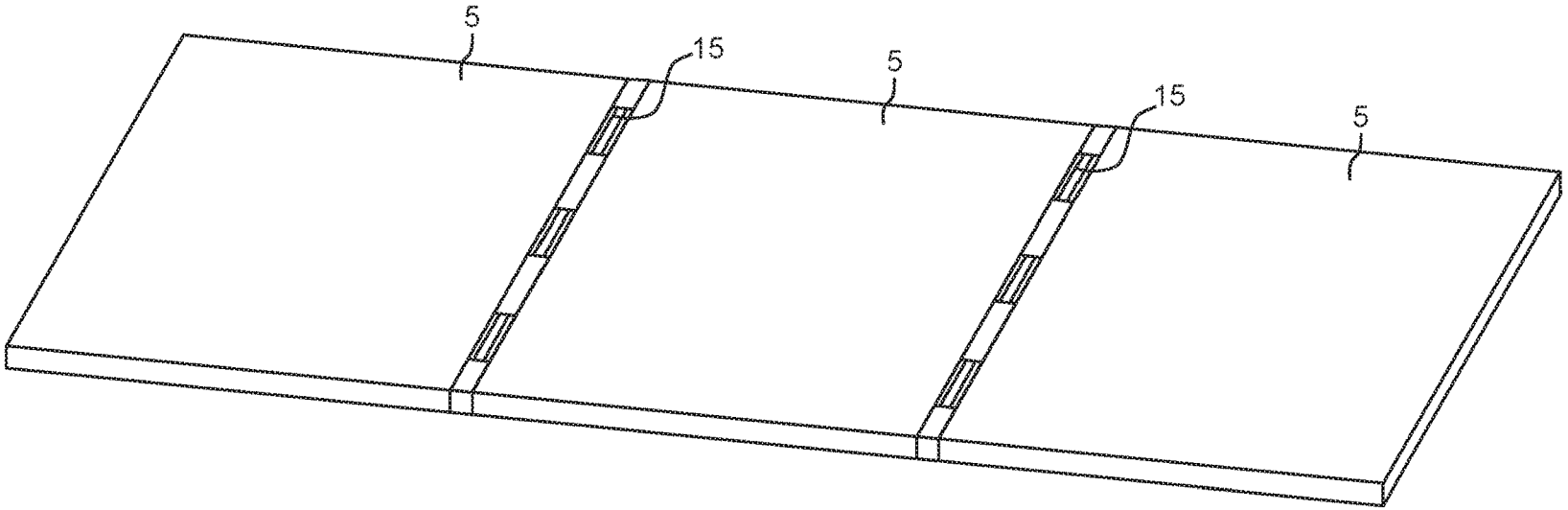
FIG. 4 is a front perspective view of a plurality of runway panels constructed in accordance with an embodiment of the present invention.

FIG. 1 illustrates a portable fashion modeling runway 1 constructed in accordance with an embodiment of the present invention. The portable fashion modeling runway 1 comprises one or more runway panels 5 (e.g., a plurality of runway panels) positioned on an underlying surface 3 and positioned proximate to one or more other runway panels 5. As illustrated in FIG. 1, the runway panels 5 are overlapping, and in contact with other runway panels 5. In alternative embodiments, the runway panels 5 may be proximate to one another and not in contact with one another (see e.g., FIG. 2). In further alternative embodiments, the runway panels 5 are in contact with one another (see e.g., FIGS. 3 and 4). In the embodiment illustrated in FIG. 1, while the runway panels 5 are overlapping, they are not coupled to one another by anything other than the force of gravity. In alternative embodiments, however, the contacting runway panels 5 may optionally be coupled to one another with any number of fasteners 13, including, but not limited to, screws, bolts, clamps, magnets, tape, glue, hook and fastener material (e.g., Velcro®), as well as by static electricity, friction, or inter-locking, inter-connecting, or hinged design. For example, FIG. 4 illustrates an embodiment where the runway panels 5 are connected using hinges 15.

The runway panels 5 illustrated in FIG. 1 are not connected to the underlying surface 3. The runway panels 5 simply rest on the underlying surface 3 due to the force of gravity. In alternative embodiments, however, the runway panels 5 may be connected to the underlying surface 3 any number of suitable ways, including, but not limited to, using screws, bolts, clamps, magnets, tape, glue, hook and fastener material (e.g., Velcro®), static electricity, or friction. In one embodiment, the runway panels 5 may removably adhere to the underlying surface 3. In one embodiment, the runway panels 5 may removably adhere to each other, such that a panel overlaps an adjacent panel and adheres thereto, such that the portable fashion modeling runway 1 is functionally a single large structure comprising individual runway panels 5.

Each of the runway panels 5 illustrated in FIG. 1 are rectangular-shaped and measure approximately 22-inches by 28-inches. However, the runway panels 5 may be any suitable shape and dimension that is sufficiently compact such that, when disassembled, the portable fashion modeling runway 1 and its runway panels 5 are portable. Preferably, the runway panels each have a shape that allows each panel to engage at least two other panels without any open area between the panels. For example, squares, rectangles, chevrons, crescents, or the like. In one embodiment, each of the runway panels 5 has an identical shape. In an alternative embodiment, the runway panels 5 may have a plurality of shapes, such that each of the plurality of shapes is engageable with at least one other of the plurality of shapes. In a preferred embodiment, the portable fashion modeling runway 1 and its runway panels 5 are sufficiently compact to be carried by hand. Depending on the dimensions of and the number of runway panels 5 used, the assembled portable fashion modeling runway 1 can range from a few feet in length to several hundred feet in length, though in the preferred embodiment, the length is approximately 16-feet.

The runway panels illustrated in FIG. 1 are comprised of paper. However, the runway panels 5 may be comprised of any number of suitable materials. For example, the runway panels 5 may be comprised of recycled paper, cardboard, plastic (e.g., plastic comprised of recycled beverage bottles), rubber, vinyl, silicone, fiberglass, foam, cloth (e.g., duck cloth, canvas), and the like. As is illustrated in FIG. 1, the runway panels 5 will be stepped on, so a durable material is preferable.

The runway panels 5 may be comprised of, impregnated with, or coated with a luminescent material 6*a*. In the embodiment illustrated in FIG. 1, the runway panels 5 may be comprised of, impregnated with, or coated with a material that fluoresces when exposed to ultraviolet radiation, such as that emitted by a black light. In an alternative embodiment, the runway panels 5 may be comprised of, impregnated with, or coated with one or more phosphorescent materials 6*b*, including, but not limited to, phosphorescent paints, gels, markers, powders, tapes, and thread. Such materials are more commonly referred to as "glow-in-the-dark" materials. In a further alternative embodiment, the runway panels 5 may be comprised of, impregnated with, or coated with neon colors.

Figure 2:
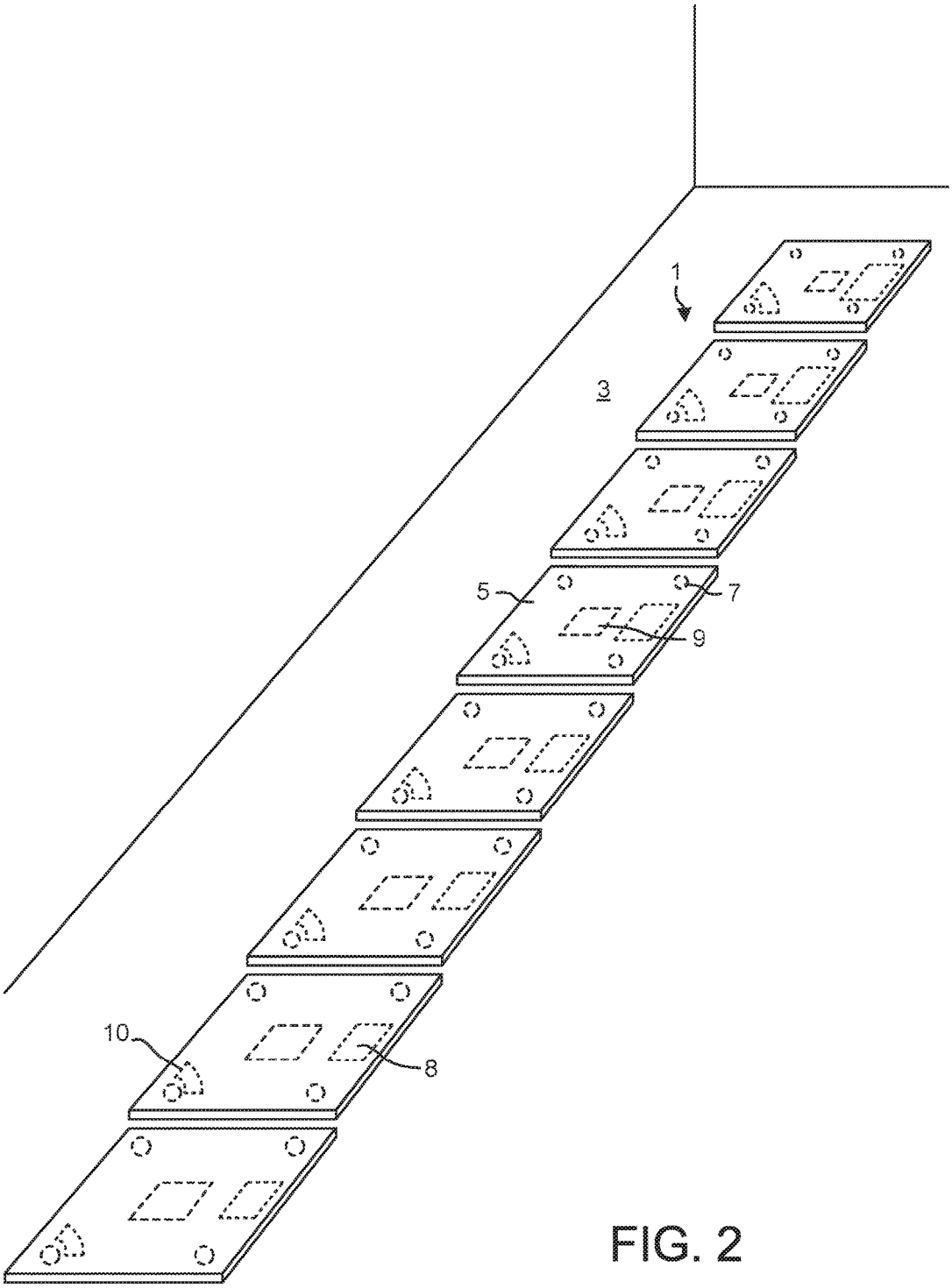
FIG. 2 is a front perspective view of a portable fashion modeling runway system constructed in accordance with another embodiment of the present invention and shown in the assembled position.

In an alternative embodiment illustrated in FIG. 2, the runway panels 5 are lighted using one or more sources of light 7. The sources of light 7 illustrated in FIG. 2 are light emitting diodes ("LEDs"), but could alternatively be incandescent, or fluorescent. The sources of light 7 illustrated in FIG. 2 are powered by one or more batteries 8, but could alternatively be powered by plugging the sources of light 7 into an electrical outlet. An advantage of battery power, however, is that it eliminates the risk of a person tripping on a power cord. A low voltage power source can also be utilized with thin distribution wires extending through each panel. Alternatively, each panel may be conductive or have conductive portions providing for wireless powering of lights placed on the runway panel 5. The sources of light 7 in FIG. 2 are manually controlled (e.g., through a controller), and the individual runway panels are all illuminated the same (e.g., all on or all off). The sources of light 7 may alternatively be controlled automatically, such as by using a microprocessor 9. In such an arrangement, the runway panels 5 can all be illuminated the same (e.g., all on or all oft) or controlled individually (e.g., each runway panel can be selectably illuminated). Similarly, the automatically controlled runway panels may be programmed to light at a specified sequence such as, for example, to be set to music or a specified beat or cadence. In an alternative embodiment, the sources of light 7 may be activated using touch sensors 10, such that, for example, the lighted runway panels 5 are illuminated when a person steps on them.

Regardless of whether or not the runway panels 5 are lighted, the portable fashion modeling runway 1 may be configured to be comprised of a single color or a combination of colors, such that it can be tailored to a specific event or holiday. For example, the colors may be selected to coordinate with a given holiday (e.g., red, pink, and white for Valentine's Day; multicolor for Mardi Gras; green and white for St. Patrick's Day; red, white, and blue for Independence Day; brown and orange for Thanksgiving; red and green for Christmas; and blue and silver for Hanukkah; etc.) or event (e.g., pink for Breast Cancer Awareness Month). Similarly, all or a portion of the runway panels 5 may be blank white such that they can be personalized by writing on them.

The portable fashion modeling runway 1 is not only for modeling apparel. Rather, it can also be used as a decorative item for any type of event, such as glow-in-the-dark, black light, or neon parties.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments, and with various modifications, as are suited to the particular use contemplated.

What is claimed is:

1. A portable fashion modeling runway comprising:

a plurality of runway panels disposed on an underlying surface and each panel in the plurality of runway panels positioned proximate to another panel in the plurality of runway panels, the plurality of runway panels comprising a first panel, a second panel, and a third panel, the first panel comprising a first top surface and a first bottom surface disposed axially from the first top surface, wherein a first portion of the first bottom surface is in contact with the underlying surface;

the second panel comprising a second top surface and a second bottom surface disposed axially from the second top surface, wherein a first portion of the second bottom surface is in contact with the underlying surface;

the third panel comprising a third top surface and a third bottom surface disposed axially from the third top surface, wherein a first portion of the third bottom surface is in contact with the underlying surface;

a second portion of the first bottom surface of the first panel overlapping a first portion of the second top surface of the second panel such that a second portion of the second top surface is uncovered, the second portion of the second top surface planar to the first portion of the second top surface, the first panel comprising a first phosphorescent material comprising a first color;

a second portion of the second bottom surface of the second panel overlapping a first portion of the third top surface of the third panel such that a second portion of the third top surface is uncovered, the second portion of the third top surface planar to the first portion of the third top surface, the second panel comprising a second phosphorescent material comprising a second color; and the third panel comprising a third phosphorescent material comprising a third color, the first color, the second color and the third color being a different color.

2. The portable fashion modeling runway of claim 1, wherein each panel in the plurality of runway panels is removably affixed to the underlying surface.

3. The portable fashion modeling runway of claim 2, wherein each panel in the plurality of runway panels is removably affixed to the underlying surface with a fastener chosen from a group consisting of screws, bolts, clamps, magnets, tape, glue, hook and fastener material, static electricity, or friction.

4. The portable fashion modeling runway of claim 1, wherein each panel in the plurality of runway panels is removably affixed to at least one other runway panel.

5. The portable fashion modeling runway of claim 4, wherein each panel in the plurality of runway panels is removably affixed to at least one other runway panel with a fastener chosen from a group consisting of screws, bolts, clamps, magnets, tape, glue, hook and fastener material, static electricity, or friction.

6. The portable fashion modeling runway of claim 4, wherein each panel in the plurality of runway panels is interconnected with at least one other runway panel.

7. The portable fashion modeling runway of claim 1, wherein the plurality of runway panels are of a material chosen from a group consisting of recycled paper, cardboard, plastic, rubber, vinyl, silicone, fiberglass, foam, or cloth.

8. The portable fashion modeling runway of claim 1, wherein each panel of the plurality of runway panels comprises one or more materials that fluoresces when exposed to ultraviolet radiation.

9. A portable fashion modeling runway comprising:

a plurality of runway panels disposed on an underlying surface and each panel in the plurality of runway panels positioned proximate to another panel in the plurality of runway panels, the plurality of runway panels comprising a first panel, a second panel, and a third panel, the first panel comprising a first top surface and a first bottom surface disposed axially from the first top surface, wherein a first portion of the first bottom surface is in contact with the underlying surface;

the second panel comprising a second top surface and a second bottom surface disposed axially from the second top surface, wherein a first portion of the second bottom surface is in contact with the underlying surface;

the third panel comprising a third top surface and a third bottom surface disposed axially from the third top surface, wherein a first portion of the third bottom surface is in contact with the underlying surface;

a second portion of the first bottom surface of the first panel overlapping a first portion of the second top surface of the second panel such that a second portion of the edge second top surface is uncovered, the second portion of the second top surface planar to the first portion of the second top surface, the first panel comprising a first battery, a first plurality of lights comprising a first color, and a first processor operably connected to a controller and configured to control the first plurality of lights;

a second portion of the second bottom surface of the second panel overlapping a first portion of the third top surface of the third panel such that a second portion of the third top surface is uncovered, the second portion of the third top surface planar to the first portion of the third top surface, the second panel comprising a second battery, a second plurality of lights comprising a second color, and a second processor operably connected to the controller;

the third panel comprising a third battery, a third plurality of lights comprising a third color, and a third processor operably connected to the controller, the first color, the second color and the third color being a different color, and each of the first panel, second panel and third panel are illuminated with a plurality of lights, the controller configured to cause the first plurality of lights, second plurality of lights, and third plurality of lights to illuminate and deluminate in a sequence.

10. The portable fashion modeling runway of claim 9, wherein the plurality of lights are chosen from a group consisting of light emitting diodes, incandescent lights, or fluorescent lights.

11. The portable fashion modeling runway of claim 9, wherein the plurality of lights are powered by a mobile energy source.

12. The portable fashion modeling runway of claim 9, wherein the plurality of lights are activated using touch sensors.

* * * * *